United States Patent [19]

Inamorato et al.

[11] 3,954,675

[45] May 4, 1976

[54] HEAVY DUTY OXIDIZING BLEACH STABLE LIQUID LAUNDRY DETERGENT

[75] Inventors: Jack T. Inamorato, Westfield; Robert W. McDonnell, Teaneck, both of N.J.

[73] Assignee: Colgate-Palmolive Company, New York, N.Y.

[22] Filed: June 24, 1974

[21] Appl. No.: 482,624

Related U.S. Application Data

[63] Continuation of Ser. No. 258,604, June 1, 1972, abandoned.

[52] U.S. Cl. ..... 252/543; 252/551; 252/DIG. 1; 252/DIG. 14

[51] Int. Cl.[2] ..... C11D 9/44

[58] Field of Search ..... 252/543, 551, DIG. 1, 252/DIG. 14; 260/240 C, 240 CA, 505 R

[56] References Cited

UNITED STATES PATENTS

| | | | |
|---|---|---|---|
| 3,449,333 | 6/1969 | Dorlars et al. | 260/240 CA |
| 3,565,939 | 2/1971 | Beiser | 252/551 |
| 3,575,866 | 4/1971 | Strobel et al. | 252/543 |

*Primary Examiner*—Mayer Weinblate
*Assistant Examiner*—Charles R. Wolfe, Jr.
*Attorney, Agent, or Firm*—Norman Blumenkopf; Herbert S. Sylvester; Murray M. Grill

[57] ABSTRACT

A clear liquid synthetic organic heavy duty laundry detergent composition for use with an oxidizing bleach such as chlorine bleaches comprising a non-ionic and anionic biodegradable synthetic organic detergent system, water, an alcohol and at least one oxidizing bleach stable brightening agent selected from 4,4′-Bis(4-phenyl-1,2,3-triazol-2-yl)-2,2′stilbene disulfonic acid and salts thereof, 4,4′-diphenylvinylene-2,2′biphenyl disulfonic acid, and salts thereof. Small proportions of various additional optional agents such as sequestering agents and saltforming bases may also be included in the composition which is a single phase clear stable liquid which can be made opaque, creamy or opalescent if desired. The composition furthermore is substantially neutral or only slightly alkaline when measured at a 1% concentration in water and cleans and brightens soiled laundry to a degree comparable to that utilizing phosphate built alkaline detergents. Furthermore, by a judicious choice of non-ionic biodegradable detergents, the liquid detergent composition may be made to be non-gelling on standing in contact with the atmosphere.

3 Claims, No Drawings

HEAVY DUTY OXIDIZING BLEACH STABLE LIQUID LAUNDRY DETERGENT

This is a continuation of application Ser. No. 258,604 filed June 1, 1972, now abandoned.

This invention relates to a substantially neutral liquid laundry detergent for use in heavy duty laundering of soiled clothing and other cloth or fabric articles in conjunction with various oxidizing bleaches, such as chlorine bleaches. More particularly, this invention relates to a substantially builder-free, clear, biodegradable liquid detergent composition which functions comparably to conventional phosphate built or nitrilotriacetate built commercial heavy duty laundry detergents, which detergent composition is not affected by oxidizing bleaches.

In recent years, due to the sharply increasing awareness of the possible disruptive effects of the ecology attending discharge of various pollutants into ground waters, streams, rivers and lakes, there has been a large scale effort on the part of manufacturers of detergent compositions in order to eliminate non-biodegradable synthetic organic detergents, as well as polyphosphate builder constituents which accumulate in rivers and lakes. The removal of these materials from prior heavy duty laundry detergent compositions, however, has not been without attendant difficulties since many of the biodegradable synthetic organic detergents do not have as desirable detersive properties as the prior non-biodegradable detergent materials, i.e. branched chain alkylaryl sulfonates. Furthermore, the polyphosphates have been difficult to remove while still maintaining a desirable cleaning power since these materials are excellent builders, sequestering and soil-suspending agents. Furthermore, those materials which have been proposed as substitutes for polyphosphates, such as NTA, themselves have some undesired properties which often renders them unacceptable for use with heavy duty liquid detergent compositions.

The more or less ecology acceptable non-phosphate containing biodegrable detergent compositions which have evolved as a result of this research have often not had the cleaning power or the prior art alkaline built detergents. For this reason, the importance of brighteners which have always been recognized as desirable components in cleaning compositions since the housewife not only expects a clean wash but a bright and white wash, has become emphasized since one of the major complaints with ecology-type detergents is that they leave the laundry with a dingy tint. However, many of the brighteners which have been utilized with ecology-type liquid detergents are not stable in the presence of oxidizing bleaches, such as chlorine bleaches, and react with these bleaches to form highly colored compounds which destroy the brightening power of the composition and lessen the bleaching power of the chlorine bleach. Although this highly-colored compound appears to disappear rapidly and therefore the housewife may not notice the same, the brightening power of the composition as well as the bleaching power of the bleach is markedly reduced, thereby resulting in less than desirable results. Those brighteners which are bleach stable or oxidant stable are generally unsatisfactory for use in liquid detergents because they are highly insoluble in the alcohol-water base of the liquid biodegradable detergent compositions.

It is within the above environment and background that the novel composition of the present invention was developed. Briefly, such composition comprises a detergent base comprising non-ionic and anionic biodegradable detergents, water, an alcohol and at least one oxidizing bleach stable brightener selected from 4,4'-Bis(4-phenyl-1,2,3-triazol-2-yl)-2,2'stilbene disulfonic acid 4,4'-diphenylvinylene-2,2'biphenyl disulfonic acid and mixtures thereof.

It is therefore the primary object of the present invention to provide a biodegradable liquid detergent composition which is stable in contact with oxidizing bleaches.

It is a further object of the present invention to provide a heavy duty liquid detergent composition containing substantially no builders with a cleaning performance substantially equal to alkaline phosphate built detergents.

It is a still further object of the present invention to provide a heavy duty biodegradable liquid detergent composition which can be utilized in conjunction with chlorine-type bleaches.

It is a still further object of the present invention to provide a biodegradable liquid detergent composition containing an improved brightener system including 4,4'-Bis(4-phenyl-1,2,3-triazol-2-yl)-2,2'stilbene disulfonic acid, 4,4'-diphenylvinylene-2,2'biphenyl disulfonic acid and mixtures thereof.

Still further objects and advantages of the novel composition of the present invention will become more apparent from the following more detailed description thereof.

The novel heavy duty liquid oxidizing bleach stable detergent of the present invention comprises from 30 to 80 weight percent of a detergent system, from 5 to 35% by weight water, from 5 to 35 % by weight of an alcohol, and from 0.5 to 5% by weight of a fluorescent brightener system including at least one oxidizing bleach stable brightener selected from the group consisting of 4,4'-Bis(4-phenyl-1,2,3-triazol-2yl)-2,2'stilbene disulfonic acid and salts thereof, 4,4'-diphenylvinylene-2,2'biphenyl disulfonic acid and salts thereof and mixtures thereof.

The selection of optical brighteners for use with heavy duty liquid detergent compositions depends upon a great number of factors including their solubility in the liquid detergent composition solvent system. Furthermore, since optical brighteners are generally specific with regard to the fibers and fabrics which they effectively whiten, the liquid detergent composition should contain a mixture of various optical brighteners, some of these brighteners effective to brighten cotton and similar materials and others effective to brighten nylons, polyesters and other synthetics commonly used in the manufacture of clothes and other garments. Since cotton articles of clothing are often bleached with an oxidizing bleach such as chlorine-type bleach, it is also important that the cotton brighteners be oxidant bleach stable. It has been found that many cotton bleaches, although they effectively whiten and brighten cotton in the absence of oxidizing bleaches, are not bleach stable and form highly colored compounds in the presence of oxidizing bleaches. The formation of these highly colored compounds reduces the brightening power of these materials and also reduces the bleaching power of the oxidizing bleach. Accordingly, by combining these materials, the housewife actually is worse off than if she had used either product individually. It has been found, however, that the utilization of an oxidant bleach stable cotton brightener selected from the group consisting of 4,4'-Bis(4-phenyl-1,2,3-triazol-2-yl)-2,2'stilbene disulfonic acid and salts thereof, 4,4'-diphenylvinylene-2,2'biphenyl disulfonic acid and salts thereof and mixtures thereof effectively whitens and brightens cotton clothing articles and further does not form any colored compounds or react in any way with the bleaching compound thereby allowing the bleaching compound to act with full efficacy.

In addition to the above two bleach stable cotton optical brighteners, the bleaching system of the present invention may also include a very small amount of a stilbene type brightener. Generally, these stilbene brighteners are not particularly oxidant bleach stable, however, a small amount is desirable since, if the liquid detergent composition is utilized without bleach, the extra brightening effect of these materials then becomes important. Furthermore, the brightening system of the present invention may also includes polyester brighteners which are increasing in importance since polyesters are being utilized to a greater extent in textiles for the production of garments. Generally, these polyester brighteners have one of the following formulas wherein R may be hydrogen, lower alkyl, lower alkanol, lower aminoalkanol, anilino, morpholino, etc., and X, Y and Z include hydrogen, lower alkyl, lower alkanol, lower aminoalkanol, anilino,. morpholino, halogens and sodium sulfonate.

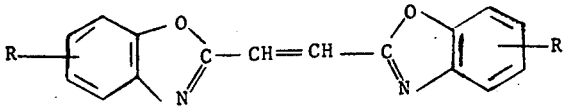

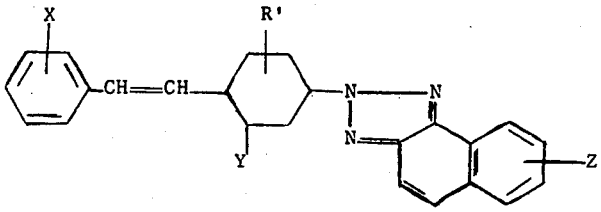

The brighteners are used in their acid forms or as salts. They may be employed as solids or in solutions and may be cut with a carrier powder. Although the chemical and physical forms can affect brightening actions, if the compounds are used in soluble forms, brightening activities for the same compounds on an active ingredient basis will be equivalent. In the present compositions and in the wash waters resulting, the brighteners are maintained sufficiently soluble so as to be effective and uniformly substantive to the materials of the laundry being washed.

Although the above-noted polyester brighteners also have some brightening effect on polyamides, the brightening system of the present invention may also include a small amount of the following polyamide-type brighteners which are especially good for nylons. In the following compounds, the R, R', X and Y groups are the same as those previously noted with respect to the polyester brighteners.

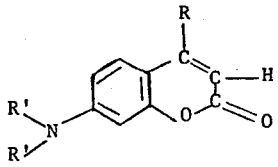

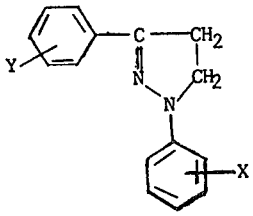

With regard to the brighteners utilized in the brightener system of the present invention, generally the acid or non-ionic forms of these brighteners tend to be solubilized by alcohols which are present in the liquid heavy duty detergent composition of the present invention while the salts tend to be water-soluble. Thus, by utilizing a combination of the water and alcohol solvents in combination with the various non-ionic and anionic detergents of the present composition helps maintain these fluorescent brighteners in solution in the novel liquid heavy duty detergent composition of the present invention.

As noted above, the total brightener content is generally at most about 5% of the liquid detergent composition. Preferably, of this 5%, the oxidizing bleach stable brighteners, i.e. 4,4'-Bis(4-phenyl-1,2,3-triazol-2-yl)-2,2'stilbene disulfonic acid and 4,4'-diphenylvinylene-2,2'biphenyl disulfonic acid, are present in amounts ranging from 0.5 to 3% by weight with the non-bleach stable brighteners comprising up to 2% and preferably up to 1%. Preferably, the total brightener concentration of the liquid detergent composition of the present invention comprises from 0.5 to 3% by weight, the majority of this brightener system comprising the above-noted chlorine or oxidizing bleach stable brighteners.

Although the above-noted brightener system may be utilized with any liquid detergent composition, it is preferred to utilize these brighteners in combination with a biodegradable liquid detergent composition comprising a non-ionic detergent having the formula $RO(C_2H_4O)_nH$, wherein R is an alkyl group, preferably having a straight chain having from 10 to 20 carbon atoms and $n$ is a number of from 5 to 14 with the proviso that n is from about two-fifth to 1 times the average number of carbon atoms in R, and an anionic detergent of the formula $RO(C_2H_4O)_nSO_3M$, wherein R is a fatty alkyl from 10 to 20 carbon atoms, n is a number of from 2 to 6, preferably from one-fifth to one-third of the number of carbon atoms in R and M is a salt-forming ion generally selected from alkali metals, ammonium, lower alkylamino and lower alkanolamino. The non-ionic and anionic detergents are preferably present in a weight ratio of from 15:1 to 1:1 non-ionic to anionic.

The preferred biodegradable synthetic organic detergent combination for use in the present concentrated clear liquid detergent compositions includes a non-ionic condensation product of fatty alcohol with ethylene oxide or ethylene glycol. Normally, the condensation will be with ethylene oxide, which is cheaper and which does not require the removal of by-product water. Methods for the manufacture of such compounds are well-known and these materials have been previously employed in detergent compositions, although generally their use has been limited to being part of the active organic detergent portion of light duty liquids. The non-ionics are of the formula $RO(C_2H_4O)_nH$, wherein R is a straight chain alkyl of 10 to 20 carbon atoms and $n$ is from 5 to 14. Generally, due to the methods of manufacture, mixed alkyls are employed and the ethylene oxide chains will include different chain lengths within the 5 to 14 ethylene oxide radical range. There is a measure of criticality in having the detergent fatty alkyl and ethylene oxide chain lengths within the ranges given so as to obtain good detersive properties together with desirable solubilities and compatibilities with other detergent compositions ingredients. Generally, the alkyl group will be 11 to 16 carbon atoms and usually the average carbon contents of preferred compounds are 11 or 14 to 15. In the most preferred non-ionic detergent compounds the alkyl groups will be essentially, i.e. over 80%, of 14 to 15 carbon atom chain lengths. Similarly, it is preferable to have from 5 to 6 or 10 to 12 ethylene oxide radicals per chain and in a most preferred embodiment these will average about and very preferably, be essentially equal to 11 ethylene oxides per chain. Preferred non-ionics that are used are Neodol 4511 (R = mixed 14 and 15 carbon atoms atoms alkyls, $n$ = 11, average value), made by Shell Chemical Co., and a compound wherein $n$ = 5 or 6 and R = 11 (10–12) made by Monsanto Co. The desired hydrophile-lipophile balance is maintained by keeping the $n$ equal to about two-fifths to 1 times R.

In addition to the chain lengths of the hydrophilic and lipophilic portions of the detergent being within the mentioned ranges, for best detergency and biodegradability it is important that such portions be of certain configurations. Of necessity, the ethylene oxide chain will be linear and will be terminated in a free hydroxyl. The alkyl group also most preferably will be linear although a minor degree of slight branching, as at a carbon next to or two carbons removed from the terminal carbon of a straight chain and away from the ethoxy chain may be tolerated, providing that such branching alkyl portion is of no more than three carbon atoms in length. Usually the proportion of carbon atoms in such branching configuration will be very minor, rarely being more than 20 or 10% of the entire alkyl content of carbon atoms.

Although the linear alkyls which are terminally joined to the ethylene oxide chains are highly preferred and result in the best detergency, biodegradability and other important properties of liquid detergents, medial or secondary joinder to the ethylene oxide chain may occur in a minor proportion of such alkyls and generally such proportion will be less than 20% and preferably less than 10% thereof. A further change that is tolerable in such compounds includes the presence of small quantities of propylene oxide, instead of ethylene oxide, but usually the propylene oxide content will be sufficiently minor so that the hydrophilic chains are essentially of ethylene oxide, generally over 80% and preferably over 90% thereof.

The sulfated, ethoxylated higher fatty alcohol detergent used herein is of the formula $RO(C_2H_4O)_nSO_3M$, wherein R is a fatty alkyl of 10 to 20 carbon atoms, n is 2 to 6, being from one-fifth to one-third of the number of carbon atoms in R, and M is a solubilizing, salt-forming cation, such as alkali metal, ammonium, lower alkylamino or lower alkanolamino. To make the anionic detergent most readily biodegradable and of better detergency, the fatty alkyl is terminally joined to the polyethenoxy chain which, of necessity, is also terminally joined to the sulfur, forming a sulfate group. Although slight branching of the higher alkyl may be tolerated, to the extent of not more than about 10% of the carbon atom content of the alkyl not being in a straight carbon chain, generally even this minor deviation from linear structure is to be avoided. Also, medial joinder of the alkyl to the polyethenoxy chain should be minimal, generally less than 10%, and even such joinder should preferably be concentrated near the end of the alkyl chain. Within the 10 to 20 carbon atom alkyl groups, preferred alkyls are of 12 to 15 carbon atoms and of these, the most preferred is a mixed alkyl, containing 12, 13, 14 and 15 carbon atom chains. The mixture is preferably one with at least 10% of each chain length and no more than 50% of any one such chain length.

The ethylene oxide content of the anionic detergent is such that n is from 2 to 6 and is preferably from 2 to 4, generally averaging about 3, especially when R is a mixed 12–15 carbon atom alkyl mixture. To maintain a desired hydrophilic-lipophilic balance, when the carbon content of the alkyl chain is in the lower portion of the 10–20 range, the ethylene oxide content might be reduced so that n is about 2, whereas when R is of 16 to 18 carbon atoms, $n$ may be from 4 to 6. The salt-forming cation may be any suitable solubilizing metal or radical but will most frequently be alkali metal or ammonium. If alkylamine or lower alkanolamine groups are present, alkyls and alkanols thereof will usually contain one to four carbon atoms and the amines and alkanolamines may be mono-, di- or trisubstituted, e.g., monoethanolamine, diisopropanolamine, trimethylamine.

The importance of using the correct anionic detergent in the present compositions is shown by the failure of corresponding alcohol sulfates in similar liquid detergent compositions to wash as well as the present compositions containing the described higher alcohol-ethylene oxide sulfates. For example, a higher alcohol sulfate in which the alcohol is mixed 12-15carbon atoms alcohol, exhibits a significantly poorer detergency in liquid compositions like those of the present invention, compared to the corresponding ethoxylated sulfate in the same composition. Even within the preferred range of alcohol polyethenoxy sulfates, an improvement in detergency is noted for the compositions which include a mixed 12–15 carbon atoms alcohol polyethenoxy sulfate, when compared to other higher alkyl ethenoxy sulfates, such as a mixed 14–15 carbon atoms polyethenoxy sulfate of the same ethenoxy chain length. The preferred detergent is available from Shell Chemical Company and is identified by them as Neodol 25-3S, the sodium salt, normally sold as a 60% active material, including about 40% of aqueous solvent medium, of which a minor proportion is ethanol. Although Neodol 25-3S is the sodium salt, the potassium salt and other suitable soluble salts may also be used either in partial or complete substitution for that of sodium.

Examples of the higher alcohol polyethenoxy sulfates which may be used as the anionic detergent constituent of the present liquid composition or as partial substitutes for this include: mixed $C_{12-15}$ normal primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetraethenoxy sulfate, sodium salt; stearyl pentaethenoxy sulfate, trimethylamine salt and mixed $C_{10-18}$ normal primary alkyl triethenoxy sulfate, potassium salt. Minor proportions of the corresponding branched chain and medially alkoxylated detergents, such as those described above but modified to have ethoxylation at a medial carbon atom, e.g., one located four carbons from the end of the chain, may be employed but the carbon atom content of the higher alkyl will be the same. Similarly, the joinder of a normal alkyl may be at a secondary carbon one or two carbon atoms removed from the end of the chain. In either case, only the minor proportions previously mentioned will be present.

For most of the heavy duty liquid detergents it will be unnecessary and undesirable to utilize active detergent ingredients other than the non-ionic, anionic combination described above. Yet, for some applications minor proportions of supplementary detergents may be used. These will generally be of the non-ionic type although in some formulations other anionic, cationic, amphoteric or ampholytic detergents or surface active agents of known types may be employed. For example, there may be used higher fatty acid esters of polyethylene glycols, block copolymers of ethylene oxide and propylene oxide (Pluronics), higher alkyl-di-lower alkyl amine oxides, the sodium salts of the sulfuric acid derivatives of higher fatty alcohol condensation products with ethylene oxide, triethanolamine lauryl sulfate, straight chain alkyl sulfonates, sodium lauroyl sarcoside, cetyl triemethylammonium bromide, benzethonium chloride, dimethyl dibenzyl ammonium chloride, N-higher alkyl N, N-di-lower alkyl aminopropane sulfonates, amidosulfobetains, betains and amido-betaines. Descriptions of such additional detergents may be found in the text Synthetic Detergents by Schwartz, Perry and Berch, published in 1958 by Interscience Publishers, New York. See pages 25 to 143. It will be kept in mind that such materials will be employed only for specific purposes and in small proportions, compared to the detergent combination of the higher fatty alcohol ethylene oxide nonionic and the ethoxamer sulfate anionic and will usually be used when a specific cleaning property thereof is desirable for a particular application.

The lower alkanol employed is preferably either ethanol or isopropanol. Of the two, ethanol is preferred because of the slightly greater solubilizing power and a more pleasant odor. If ethanol is used, however, it will normally be denatured and of the denatured alcohols, those identified as SD-40 or SD-3A are preferred, although other denatured alcohols may be utilized. These alcohols do not have to be anhydrous and the water which is normally present with them may be considered as part of the water component of the liquid detergents. The lower alkanol may be replaced in whole or in part by dihydric or trihydric lower alcohols which, in addition to having solubilizing powers and reducing the flash point of the product, also act as anti-freeze constituents and improve campatibility with regard to particular components. Among these componnds, the most preferred are the lower polyols of 2 and 3 carbon atoms, i.e. ethylene glycol, propylene glycol, glycerol, but various other derivatives such as the cellusolves may also be employed, generally only to a minor degree, however.

The waters utilized in the heavy duty liquid detergent compositions of the present invention are preferably deionized so that they will have low ionic content which can form in soluble compounds. However, ordinary tap water can be utilized providing the hardness thereof is sufficiently low so that there is no precipitation of salts on standing. When sequestrants are utilized in the composition of the present invention the hardness of the water is less important and, in such cases, even waters with hardnesses of over 300 parts per million equivalent calcium carbonate can be utilized. However, the water hardness generally should be less than 150 parts per million and most preferably less than 50 parts per million.

The sequestering agent, when used, may be any suitable compound, including the aminopolycarboxylic acids and hydroxycarboxylic acids. Thus, ethylene diamine tetraacetic acid, nitrilotriacetic acid, hydroxyalkyl derivatives thereof in which the hydroxyalkyl group replaces one or more acetic acid groups, gluconic acid, ascorbic acid, glucono-delta-lactone (which is converted to gluconic acid), citric acid, lactic acid and salts thereof, especially those of the water-soluble alkali metals, e.g. sodium, potassium, etc., ammonium, alkanolamines and amines, may be used. Other sequestering or water-softening agents of the inorganic type such as a certain phosphates may be used in very small amounts if desired but are not present in amounts sufficient to have a builder function.

Adjuvants may be present in the liquid detergent to give it additional properties, either functional or aesthetic. Thus soil suspending or anti-redeposition agents, may be used such as, polyvinyl alcohol, sodium carboxymethyl cellulose, hydroxypropylmethyl cellulose; enzymes, e.g. protease amylases; thickeners, e.g., gums, alginates, agar agar; hydrotropes, e.g. sodium xylene sulfonate, ammonium benzene sulfonate; foam improvers, lauric myristic diethanolamide; foam destroyers, e.g. silicones, bactericides, e.g. tribromosalicylanilide, hexachlorophene; fungicides; dyes, pigments (water dispersible); preservatives; ultraviolet absorbers; fabric softeners; pearlescing agents; opacifying agent, e.g. behenic acid polystyrene suspensions, and perfumes. Of course, such materials will be selected for the properties desired in the finished product and to be compatible with the other constituents thereof.

The pH of the heavy duty liquid detergent composition will normally be substantially neutral or only slightly alkaline. The composition of the present invention contains a minimum of alkaline material per se, since the particulate soil removal of the particular non-ionic and anionic detergents utilized is enhanced in approximately neutral solutions. Howver for various reasons, such as solubilizing and neutralizing various brighteners used, a small amount of an alkaline material may be included. Suitable alkaline materials include mono-, di- and trialkanolamines, alkylamines, ammonium and alkali hydroxides. The preferred alkali materials are the alkanolamines, especially the trialkanolamines and most especially triethanolamine. A pH reading of the liquid detergent using a glass electrode and a reference calomel electrode, indicates a maximum pH of about 8. However, because the detergent system is essentially non-aqueous despite the presence of a minor proportion of water, the pH reading obtained may be false. A better indication is obtained by measuring the pH of a 15% solution in water. This should usually be in the range of about 6.8 to 8.8. In water containing items to be laundered, the pH will normally be within the same range.

The proportion of the various components of the present heavy duty liquid detergents are imporant to the obtainment of a uniform product and acceptable heavy duty laundering action. In the absence of a significant builder content, it is very important that the product contain a significant proportion of detergent. So as to promote solubility of the fluorescent brighteners and other constituents and make a clear, homogeneous and readily pourable liquid product, from 30 to 80% of the total liquid detergent concentrate should be a mixture of a non-ionic fatty alcohol-ethylene oxide condensation product and an anionic alkyl polyethenoxy sulfate. The preferred range is from 35 to 65% of total detergent and in the most preferred embodiment of the invention about 50% is empolyed. For the greatest effectiveness, the quantity of the anionic alkyl polyethenoxy sulfate detergent should be within the range of about 5 to 20% and preferably about one-fourth of the total non-ionic content, i.e. preferably 10%, and the non-ionic will comprise from 25 to 75% by weight and preferably 40% Suitable weight ratios of total non-ionic to anionic ranges from about 15:1 to 1:1 with 8:1 to 2:1 preferred and 5:1 to 3:1 most preferred.

The concentration of the bleach stable fluorescent or optical brightener or whitening agent in the product will be from about 0.5 to 3% on an active ingredient basis, preferably about 1 to 3% and most preferably about 2%. The total brightener system will generally comprise about 0.5 to 5% of the detergent composition with the above percentages of bleach stable brightener, with the balance up to 5% being one or more of polyamide brighteners, polyester brighteners, and stilbene-type cotton brighteners. Such quantities are readily solubilized in the clear liquid product and contribute substantially to brightening of fabrics in the laundry.

The lower alcohol will generally be present in a sufficient proportion to aid in stabilizing or dissolving various constituents of the product such as the brighteners. The proportion employed will generally be from 5 to 35%, preferably from 5 to 25%. When used without supplementing diol or triol, the quantity of alcohol present normally is from 5 to 20% but when the supplementing polyol is used the content of alcohol may be reduced to from 5 to 15%, preferably about 5 to 10%. In such circumstances, the proportion of polyol will generally be from 5 to 15%, most preferably 10%. The percentage of water utilized will also generally be from 5 to 35% and a preferred range is from 5 to 25%, with a most preferred range being from 15 to 20%. Similar considerations prevail in determining the proportion of water to be employed as do in the case of the alcohols.

The non-building proportion of sequestrant, when used, may range from 0.2 to 3%, preferably from 0.5 to 1.5%, and most preferably 0.8%.

Considering the wide range of adjuvants which may be utilized, for widely different purposes, the quantities or proportions thereof employed will vary. Generally, however, it may be said that the total thereof should not exceed 10% and will preferably be maintained less than 5% and more preferably less than about 3%. Individual components should usually not exceed 5%, preferably 3% and most preferably 1% of the product. The use of more of such compounds will often significantly change the properties of the liquid detergent and, therefore, is to be avoided.

The heavy duty liquid detergents of the present invention can be made by simple manufacturing techniques which do not require any complicated equipment or expensive operations. In a typical manufacturing method, the optical brighteners may be slurried in the monohydric alcohol or mixture of monohydric and polyhydric alcohol. If initially slurried in the monohydric alcohol, subsequently the polyhydric alcohol, if used, may be added to this. Then water and, if necessary, a small amount of base such as triethanolmmine is added, which helps to partially dissolve the previously suspended material but not yield a clear solution. Addition of the detergent combination causes the remainder of the brightener to dissolve to make a clear solution. Then the sequestrant, if used, may be added as the acid or salt (preferably the sodium, potassium or amine salt) and agitation is continued until the solution becomes clarified, which will normally take about 5 to 10 minutes. At this point, perfume and dye may be added to give the product its final desired appearance and odor. All of the operations may be effected at room temperature, although suitable temperatures within the range of 10° to 80°C. may be employed, as desired. Additions of adjuvants may be effected at suitable ponts in the process but for the most part these will be added to the final product. The product obtained will usually have a pH within the range of from 6.8 to 8.8, e.g. 7.0 and a density within the range of from 0.9 to 1.1, preferably from 0.95 to 1.05 and most preferably from 0.98 to 1.02. The viscosity of the product at 25°C. will usually be from 20 to 200 centipoises, preferably from 50 to 150 cps., and will be in the higher part of this range if a polyhydric alcohol is used in replacement of some lower monohydric alcohol.

Use of the present compositions is marvelously simple and efficient. Compared to present heavy duty laundry detergent powders, much smaller volumes of the present liquids may be employed to obtain cleaning of soiled laundry. For example, in a typical and preferred formulation of this invention, containing about 40% of the fatty alcohol-ethylene oxide condensate and 10% alkyl polyethenoxy sulfate, only about 2 ounces or one-fourth cup of liquid need to be used for a full top-loading automatic machine tub of wash, in which the water volume might be from 15 to 18 gallons. Thus, the concentration off liquid detergent in the wash water is on the order of 0.1%, 1gram per liter or 1,000 parts per million. Generally, the proportion employed will be from 0.7 to 1.5 grams per liter, which may correspond to 0.3 to 0.6 g/l of the mixture of fatty alcohol-ethylene oxide condensation products, from 0.075 to 0.15 g/l of alkyl polyethenoxy sulfate, from 0.01 to 0.05 g/l of the fluorescent or optical brightener system, from 0.05 to 0.4 g/l of lower monohydric alcohol and from 0.005 to 0.03 g/l of organic sequestrant. The proportions of other constituents of the liquid compositions may vary accordingly. Of course, equivalent results can be obtained by using larger proportions of a more dilute liquid detergent but the greater quantity needed will require additional packaging and shipping space and will be less convenient for the consumer to use. However, it is considered that the use of such more dilute products is within the present invention if the relative proportions of components are maintained. In other words, the present invention is not avoided by merely preliminarily diluting the liquid detergent with water since the same end result is obtained because the wsh water also serves to dilute the detergent down to a use concentration.

Although it is preferred to employ wash water of reasonable hardness and at an elevated temperature, the present invention is also useful in laundering clothes and other items in hard waters and in extremely soft waters, as well as in waters at room temperature or below. Thus, water hardnesses may range from 0 to over 300 parts per million as calcium carbonate and washing temperatures may be from 10° to 80°C. Preferably, the temperatures will be from room temperature, 20°to 25°C., to 70°C. Also, although washing will ordinarily be effected in an automatic washing machine, with the washing followed by rinse and spin or draining or wringing operations, it is contemplated that the detergent may also be used for hand washing of laundry. In such cases, the concentration in water of the liquid detergent will often be increased and sometimes it may be full strength to assist in washing out otherwise difficult to remove soils or stains. After completion of the washing and spinning operations, it will be general practice to dry the laundry in an automatic dryer soon thereater but such particular drying operation in not necessary.

When the liquid detergent is added to water, whether that water is hot or cold, the detergent immediately dissolves uniformly throughout the wash water, even in the absence of significant agitation. Washing and brightening agents are carried into contact with all the laundry and there are no localized over-concentrations of either of these materials. The clothing washed, following normal methods, is exceptionally clean and in comparative tests the product has been rated as good as some of the best commercial heavy duty detergents on the market. Although it is a low- and non-foaming detergent composition and thus very suitable for side-loading washing machines, excellent washing is also obtained in top-loading machines in which foaming detergents are normally employed. Repeated testing of soiled and re-soiled laundry items, using the present compositions and larger quantities of commercial heavy duty detergents built with phosphate or NTA, show that the soilings are repeatedly removed and no objectionable build-up thereof occurs. For the most part, users do not note any really significant differences between the washing properties of the present composition and commercial compositions tested. In fact, there has been a significant preference for the present product.

The composition of the present invention will now be more fully illustrated by the following specific examples which are illustrative and in no way limitative of the present composition wherein all parts and percentages are by weight and temperature degrees Farenheit, unless otherwise noted.

EXAMPLE 1

A clear liquid detergent having the following formula is prepared by slurrying the mixture of optical brighteners in SD-40 alcohol followed by the addition of water and triethanolamine with stirring. Subsequently, the non-ionic and anionic detergents are added and following a few minutes agitation at moderate speed the solution becomes clear:

| | |
|---|---|
| $RO(C_2H_4O)_{11}H$ (Neodol 45-11, R = mixed 14 and 15 carbon atoms primary alkyl) | 20.00 |
| Plurofac B-26 (linear alcohol ethylene oxide and propylene oxide) | 20.00 |
| $RO(C_2H_4O)_3SO_3Na$ (Neodol 25-3S, R = mixed 12, 13, 14 and 15 carbon atoms primary alkyl) | 10.00 |
| SD-40 denatured alcohol | 14.00 |
| Triethanolamine | 1.5 |
| 4,4'-Bis(4-phenyl-1,2,3-triazol-2-yl)-2,2'stilbene disulfonic acid | 1.0 |
| Perfume | 0.35 |
| Dye | 0.002 |
| Water Q.S. | |
| | 100.0 |

The pH of the 1% solution of the above formulation in water is about 7.0. This liquid detergent which is a sparkling clear, free-flowing liquid is then packed in polyetylene plastic bottles of a one quart capacity and is ready for use. Storage tests indicate this product will be stable for several years without precipitation of insoluble salts, settling into a plurality of phases, clouding, precipitation of the optical brightener or other disadvantageous effects on appearance or function.

The detergency and brightening power of the liquid detergent when combined with 200 parts per million of sodium hypochlorite bleach and a water solution, i.e. (Clorox), is excellent. In the absence of a chlorine bleach, however, the above formulation although producing a clean and bright wash is less satisfactory than the bleached sample.

EXAMPLE 2

The composition of Example 1 is utilized except that the optical brightener comprises 2.0 parts of 4,4'-diphenylvinylene-2,2'-biphenyl disulfonic acid.

When the instant composition is tested in detergency and brightening tests both with and without the chlorine bleach, both bundles produce excellent results. Furthermore, upon the pouring of a solution of sodium hypochlorite to approximately 200 parts per million, there is no visible color change.

EXAMPLE 3

The formulation of Example 1 is again utilized except that the optical brightener comprises 2.0 parts of 4,4[1]-bis[4-anilino-6-bis (2-hydroxyethyl) amino-s-triazine-2-ylamino-9 -2,2[1]-stibene disulfonic acid, disodium salt.

When the above-noted detergent composition is tested for whitening and detergency properties in the presence of a chlorine bleach and also alone, it is found that upon the pouring of a solution of sodium hypochlorite into the wash water a deep pink color quickly appears. Furthermore, upon standing, this pink color slowly disappears indicating a further reaction between the brightener and the sodium chloride bleach. Although the instant composition performed effectively when not utilized in conjunction with chlorine bleach, the use of this formulation in combination with chlorine bleach does not produce a satisfactory wash.

EXAMPLE 4

The formulation of Example 1 is repeated except that the optical brightener is replaced with an optical brightener system comprising 0.4 parts of 4,4′-Bis(4-phenyl-1,2,3-triazol-2-yl)-2,2′-stilbene disulfonic acid, 0.4 parts of 4,4′-diphenylvinylene-2,2′-biphenyl disulfonic acid and 0.2 parts of 4,4¹-bis[4-anilino-6-bis (2-hydroxyethyl)amino-s-triazine-2-ylamino]-2,2¹-stilbene disulfonic acid, disodium salt.

When the above-noted formulation is tested in conjunction with chlorine bleach, it performs quite staisfactorily with virtually no color appearing on the adding of the chlorine to the wash water solution.

Furthermore, in washing tests with the above-noted formulation utilized without chlorine bleach the whiteness and brightness of the resulting washed materials is also quite satisfactory.

While the novel liquid detergent compositon of the present invention has been illustrated by way of the foregoing specific examples and specification, the composition is to be in no way limited thereto but to be construed as broadly as any and all equivalents as properly defined in the appended claims.

What is claimed is:

1. A clear oxidizng bleach stable heavy duty liquid detergent composition substantially devoid of phosphate and nitrogeneous builder having from 30 to 80% by weight of a detergent system consisting essentially of nonionic and anionic detergent in which the weight ratio of nonionic to anionic is 15:1 to 1:1, from 5 to 35% by weight of a lower monohydric, dihydric or trihydric alkanol, from 5 to 35% by weight water and from 0.5 to 5% by weight of a fluorescent brightener system including at least a major amount of 4,4′-Bis(4-phenyl-1,2,3-triazol-2-yl)-2,2′-stilbene disulfonic acid and salts thereof.

2. The detergent composition of claim 1 wherein said detergent is a mixture of non-ionic and anionic detergents, said non-ionic detergent having the formula $RO(C_2H_4O)_nH$, wherein R is an alkyl group having from 10 to 20 carbon atoms and n is a number from 5 to 14 with the proviso that *n* is from 2/5 to 1 times the number of carbon atoms in R, and said anionic detergent has the formula $RO(C_2H_4O)_nSO_3M$, wherein R is an alkyl group having from 10 to 20 carbon atoms, n is a number from 2 to 6 and M is a salt-forming ion selected from alkali metals, ammonium, lower alkylamino and lower alkanolamino in a weight ratio of said non-ionic to said anionic of from 15:1 to 1:1.

3. The composition of claim 2 wherein said brightener system is from 0.5 to 2% by weight of 4,4′-Bis(4-phenyl-1,2,3-triazol-2-yl)-2,2′-stilbene disulfonic acid.

* * * * *